US007729625B2

(12) United States Patent
Kubo et al.

(10) Patent No.: US 7,729,625 B2
(45) Date of Patent: Jun. 1, 2010

(54) IMAGE FORMING DEVICE, IMAGE PROCESSING DEVICE, IMAGE FORMING METHOD, COMPUTER READABLE MEDIUM, AND COMPUTER DATA SIGNAL

(75) Inventors: Masahiko Kubo, Ebina (JP); Tomoshi Hara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/174,830

(22) Filed: Jul. 17, 2008

(65) Prior Publication Data

US 2009/0022511 A1 Jan. 22, 2009

(30) Foreign Application Priority Data

Jul. 19, 2007 (JP) ..... 2007-188365

(51) Int. Cl.
*G03G 15/00* (2006.01)

(52) U.S. Cl. ..... 399/49; 399/46; 399/38

(58) Field of Classification Search ..... 399/38, 399/42, 128

See application file for complete search history.

(56) References Cited

U.S. PATENT DOCUMENTS 6,553,191 B1 * 4/2003 Nakane ..... 399/38

6,697,582 B1 * 2/2004 Scheuer ..... 399/49

FOREIGN PATENT DOCUMENTS

| | | |
|---|---|---|
| JP | 2002-006527 | 1/2002 |
| JP | 2003-076076 | 3/2003 |

* cited by examiner

*Primary Examiner*—David M Gray
*Assistant Examiner*—Roy Yi
(74) *Attorney, Agent, or Firm*—Morgan, Lewis & Bockius LLP

(57) ABSTRACT

An image forming device has an imaging unit including: a rotating body; an exposure unit forming an electrostatic latent image on the rotating body; a developing unit developing the latent image using developer to form an image; and a transfer unit transferring the image to a recording medium, a memory storing data on correspondence between first image data, second image data and a first correction amount, the first image data representing a first latent image formed by a first turn of the rotating body, the second image data representing a second latent image formed by a second turn of the rotating body, and the first correction amount used for correcting the second image data so that density of the image on the recording medium closer to density of the second latent image; a correction amount determining unit determining the first correction amount corresponding to the first and second image data based on the data stored in the memory; and a correcting unit correcting the second image data based on the first correction amount.

8 Claims, 7 Drawing Sheets

IMAGE FORMING DEVICE, IMAGE PROCESSING DEVICE, IMAGE FORMING METHOD, COMPUTER READABLE MEDIUM, AND COMPUTER DATA SIGNAL

CROSS-REFERENCE TO RELATED APPLICATIONS

This application is based on and claims priority under 35 USC 119 from Japanese Patent Application No. 2007-188365 filed on Jul. 19, 2007.

BACKGROUND

1. Technical Field

The present invention relates to an image forming device, an image processing device, an image forming method, computer readable medium, and computer data signal.

2. Related Art

In an image forming device according to an electrophotographic system, latent images formed on photosensitive drums leave afterimages on the drums, as a history of formed latent images. Influence of such afterimages often results in unevenness in densities of images, each of which is formed by a turn of each photosensitive drum. The unevenness in density is known as a latent image ghost.

SUMMARY

An aspect of the present invention provides an image forming device including: an imaging unit including: a rotating body that is driven to rotate and has a surface, electric potential of which changes in response to light; an exposure unit that irradiates the surface of the rotating body on the basis of input image data to form an electrostatic latent image; a developing unit that develops the electrostatic latent image using developer to form an image; and a transfer unit that transfers the image formed by the developing unit to a recording medium; a memory that stores data on correspondence between first image data, second image data, and a first correction amount, the first image data being input to the exposure unit and representing a first latent image to be formed by a first turn of the rotating body, the second image data being input to the exposure unit and representing a second latent image to be formed by a second turn of the rotating body subsequent to the first turn, and the first correction amount being used for correcting the second image data so that density of an image transferred to a recording medium when the second image data is input to the exposure unit becomes closer to density of the second latent image represented by the second image data; a correction amount determining unit that determines the first correction amount corresponding to the first image data and the second image data on the basis of the data on correspondence stored in the memory; and a correcting unit that corrects the second image data to be input to the exposure unit, on the basis of the first correction amount determined by the correction amount determining unit.

BRIEF DESCRIPTION OF THE DRAWINGS

An exemplary embodiment of the invention will be described in detail based on the following figures, wherein.

DETAILED DESCRIPTION

An exemplary embodiment of the invention will now be described with reference to the drawings.

Figure 1:
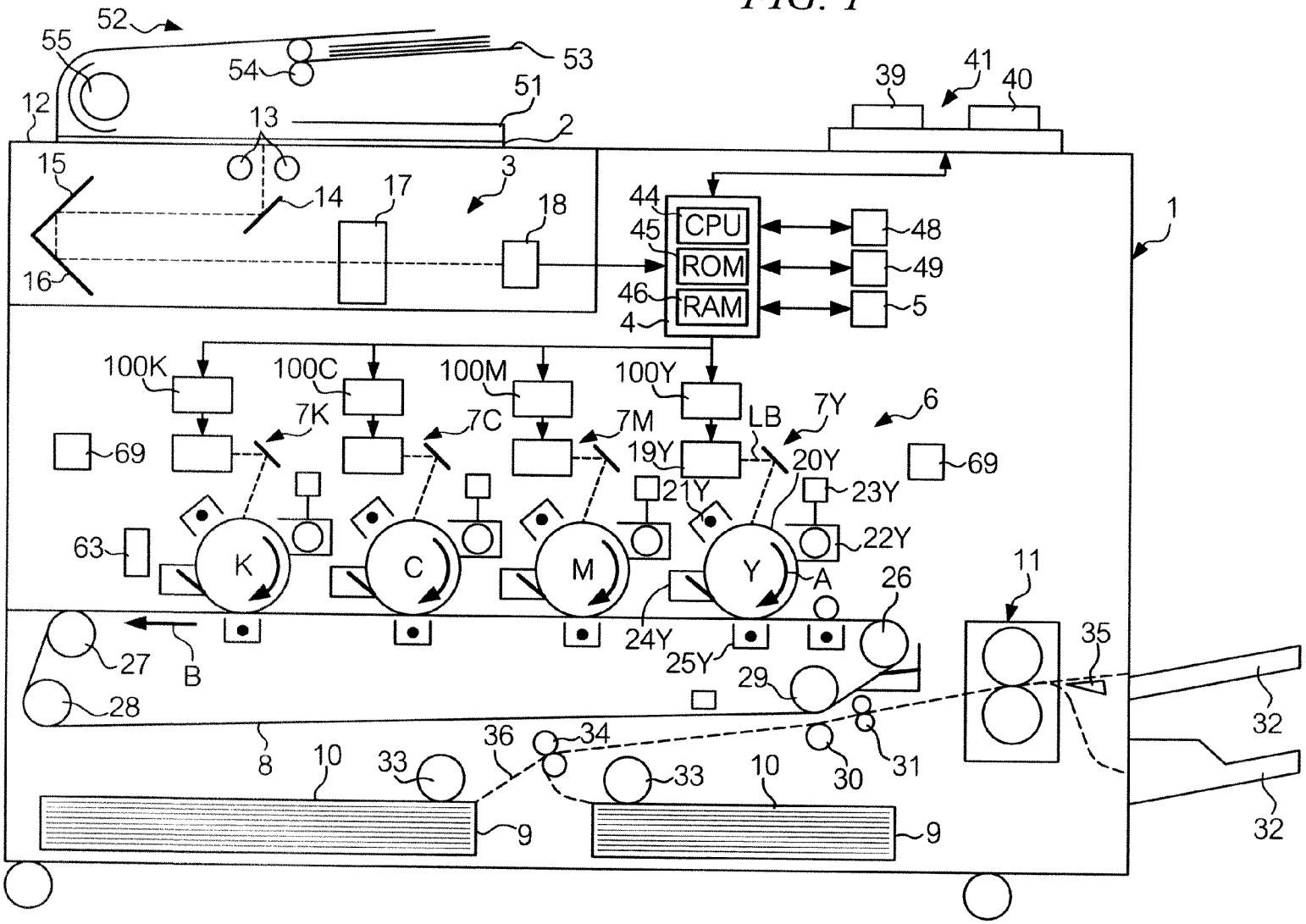
FIG. 1 shows a hardware structure of an image forming device 1.

FIG. 1 shows a hardware structure of an image forming device 1 according to this exemplary embodiment.

A controller 4 includes a CPU (Central Processing Unit) 44, a ROM (Read Only Memory) 45, and a RAM (Random Access Memory) 46. A storage unit 5 is a non-volatile memory such as a hard disk device, and stores programs such as an OS (Operating System), etc. The storage unit 5 is used to store data which is externally input to the image forming device 1. The ROM 45 stores an IPL (Initial Program Loader). When the image forming device 1 is powered on, the CPU 44 then executes the IPL thereby to read the OS into the RAM 46. The CPU 44 further executes the OS thereby to perform control of the image forming device 1.

An instruction receiving unit 41 is constituted of a display unit 39 and a key input unit 40. A user can input instructions to the image forming device 1 via the instruction receiving unit 41. The display unit 39 is, for example, a liquid crystal display screen, and displays a screen to show a menu. Further, the display unit 39 has a sensor which senses an area on the screen touched by the user, thereby to specify an item from the menu which the user has selected by touching the screen. The key input unit 40 is constituted of ten keys, a start key, a stop key, and a reset key. Instructions received by the instruction receiving unit 41 are fed to the CPU 44, which controls the image forming device 1 in accordance with the instructions.

The I/F (Interface) 48 is connected to a communication network (not shown) such as a LAN (Local Area Network) and intermediates between the image forming device 1 and other devices, to interface communications therebetween.

A cover 51 which covers a platen glass 2 is provided with a document feed device 52. The document feed device 52 is constituted of a document table 53 and rollers 54 and 55. The document table is where a document is set. The roller 54 feeds one paper sheet of a document after another. The roller 55 guides the fed paper sheets onto the platen glass 2. Plural paper sheets of a document or documents which are set on the document table 53 can be conveyed one by one onto the platen glass 2 by the document feed device 52.

The image input unit 12 optically reads a document and generates image data. More specifically, a light source 13 irradiates a document set on a platen glass 2 with light, and a light receiving unit 18 receives light reflected from the platen glass 2 through an optical system 3 constituted of mirrors 14, 15, and 16 and a lens 17. The light receiving unit 18 has a photoelectric conversion element such as a CCD (Charge Coupled Device), and generates image data which expresses an image in colors R (Red), G (Green), and B (Blue). The CPU 44 converts this image data into image data which expresses an image in four colors Y (Yellow), M (Magenta), C (Cyan), and K (Black), and buffers the converted data into a buffer area. Where the image forming device 1 is caused to function as a copying machine, each time that image data equivalent to one page is buffered into the buffer area maintained in the RAM 46, the buffered image data is converted into, for example, TIFF (Tagged Image File Format) image data which is stored into the storage unit 5.

The image output unit 6 is constituted of image forming engines 7Y, 7M, 7C, and 7K, a transfer belt 8, a fixing device 11, etc. The image forming engines 7Y, 7M, 7C, and 7K respectively form toner images in colors Y (Yellow), M (Magenta), C (Cyan), and K (Black), layered on a surface of the transfer belt 8. Since the image forming engines have a common structure to each other, only the image forming engine 7Y will representatively be described below.

The image forming engine 7Y is constituted of, for example, a charging device 21Y, an exposure device 19Y, a development device 22Y, and a transfer device 25Y, which are provided around a photosensitive drum 20Y.

The photosensitive drum 20Y is a cylindrical photosensitive member which is driven to rotate in a direction of arrow A, and has a photoconductive outer circumferential surface. The photosensitive drum 20 has a rotation axle which is equipped with an encoder (not shown). For each turn of the photosensitive drum 20Y, an index signal is output from the encoder.

The charging device 21Y electrically charges the surface of the photosensitive drum 20Y to a predetermined potential while the photosensitive drum 20Y is driven to rotate.

The exposure device 19Y is an optical scanning system which irradiates the surface of the photosensitive drum 20Y with an exposure beam LB. Specifically, the exposure device 19Y has a semiconductor laser and a rotating polygon mirror (not shown). The exposure device 19Y receives image data buffered in the buffer area, and generates an exposure beam LB to form an image for the color Y in accordance with the image data. The rotating polygon mirror is driven to rotate at a predetermined angular speed. The exposure device 19Y reflects the exposure beam LB on the rotating polygon mirror and further on the mirror 191Y, thereby to perform deflective scanning on the surface of the photosensitive drum 20Y at a predetermined speed in a main scanning direction. In this case, the main scanning direction corresponds to a direction of the rotation axis of the photosensitive drum 20Y. The exposure device 19Y writes pixel values of a latent image on the surface of the photosensitive drum 20Y in the main scanning direction, wherein the pixel values each expresses an image/area rate of a corresponding pixel of the latent image. An array of pixels in the main scanning direction will be hereinafter referred to as a scanning line. A sub-scanning direction is a direction perpendicular to the main scanning direction, which is a circumferential direction. As the photosensitive drum 20Y is rotated, partial writing of the latent image for one scanning line is repeated for each sub-scanning line.

On the surface of the photosensitive drum 20Y, electric potential at parts of the surface irradiated with the exposure beam LB drops to a predetermined level. Accordingly, an electrostatic latent image based on the image data is formed on the surface of the photosensitive drum 20Y.

The development device 22Y develops the electrostatic latent image formed on the photosensitive drum 20Y, using toner as a developer. A toner cartridge 23Y contains yellow toner, and supplies a predetermined amount of toner for the development device 22Y. The development device 22Y supplies the predetermined amount of toner onto the surface of the photosensitive drum 20Y. Accordingly, the toner adheres to parts of the surface where the electric potential has dropped due to irradiation of the exposure beam LB. A toner image is thereby formed.

The transfer belt 8 is wound around rollers 26, 27, 28, and 29 and is driven to circulate in a direction of arrow B. Below the photosensitive drum 20Y, a transfer device 25Y is provided so as to sandwich the transfer belt 8 between the photosensitive drum 20Y and the transfer device 25Y. A predetermined voltage is applied to the transfer device 25Y. The toner image formed on the surface of the photosensitive drum 20Y is transferred to the surface of the transfer belt 8 under influence of an electric field generated by the voltage applied to the transfer device 25Y (primary transfer).

A cleaner 24Y removes the toner remaining on the photosensitive drum 20Y.

The image forming engine 7Y has a structure as described above. Other image forming engines 7M, 7C, and 7K also form toner images, respectively, in corresponding colors, and the formed toner images are transferred to the transfer belt 8 so as to be layered one upon another. In the following descriptions, the image forming engines 7Y, 7M, 7C, and 7K will be simply referred to as image forming engines 7 where these engines need not be distinguished from one another. Similarly, where structures or operations of the other components need not be distinguished by colors, letters Y, M, C, and K appended to reference symbols for distinguishing those components by colors will be omitted from the reference symbols in the following descriptions.

Plural media supply units 9 are provided, and respectively contain recording media 10 of different sizes. The recording media 10 are, for example, paper sheets. After toner images are formed on the transfer belt 8, the CPU 44 rotates a roller 33 provided for one of the plural media supply units 9 for a size specified through the instruction receiving unit 41 by the user or for a size determined based on image data. Accordingly, recording media 10 are fed one after another. The fed recording media 10 are conveyed along a conveying path 36 by pairs of rollers 34, 35, and 37.

The transfer roller 30 is applied with a predetermined voltage. The transfer belt 8 is driven to circulate in the direction of arrow B. In synchronization with approach of the toner images formed on the surface of the transfer belt 8 to the transfer roller 30, the transfer roller 30 is pressed against the roller 39 through the transfer belt 8, thereby forming a contact area. As a recording medium 10 enters into the contact area, toner images on the transfer belt 8 are transferred to the surface of the recording medium 10 by effects of the voltage applied to the transfer roller 30 and a pressure applied at the contact area (secondary transfer)

The recording medium 10 on which the toner images have been transferred is guided to the fixing device 11 by a pair of rollers 31. The fixing device 11 heats and presses the recording medium 10 to fix the toner images onto the recording medium 10.

A guide member 35, which defines the conveying path for recording media 10, is provided in a downstream side of the fixing device 11. At a location at further downstream side of the fixing device 11, there are provided media output units 32, each provided with a plate member of a size that is sufficient to enable recording media 10 of a largest size to be captured. A uppermost one of the media output units 32 functions only to output the recording media 10. A lower one of the media output units 32 functions also to carry out a post process, such as stapling. Only when the user gives an instruction about the post process, the direction of the guide member 35 is changed so that the recording media 10 is output to the lower media output unit 32.

The image forming device 1 also functions as a printer. More specifically, if the image forming device 1 and an information processing device are connected to each other via a communication network and if document data described in a page descriptor language is transmitted from the information processing device to the image forming device 1, the CPU 44 converts the document data into image data and supplies the image data to the image output unit 6. In this case, when a user specifies desired image data stored in the storage unit 5, the specified image data is supplied to the image output unit 6.

There are several known factors which can cause the phenomenon of a latent image ghost. One of the factors is concentration of a transfer current. As has been described previously, when a toner image is transferred from a photosensitive drum 20 to the transfer belt 8, a predetermined voltage is applied to the transfer belt 8. A current which is caused to flow by application of a predetermined voltage is referred to as a transfer current. Desirably, such a transfer current should flow uniformly through the surface of the photosensitive drum 20. However, the flow of the transfer current is not uniform in actuality. Specifically, there is a tendency such that the transfer current scarcely flows through areas where the toner adheres to the photosensitive drum 20, but flows in concentration in areas where no toner adheres to the photosensitive drum 20. In those areas where the transfer current is concentrated, an electric potential drops to become lower than that in other areas, i.e., the electric potential in the areas where no toner adheres is lower than in the other areas where the toner adheres. This distribution of different electric potentials remains on the surface of the photosensitive drum 20 even after transfer of the toner image.

Areas on the photosensitive drum 20 to which the toner has adhered in an immediately previous transfer operation will be hereinafter referred to as toner adhesion areas, for convenience of explanation. Areas on the photosensitive drum 20 to which no toner has adhered will be hereinafter referred to as no-toner adhesion areas. After transferring a toner image, the electric potential in no-toner adhesion areas is lower than that in toner adhesion areas.

A part of the surface of the photosensitive drum 20 from which a toner image has been transferred is newly electrically charged for a next exposure operation. After thus newly electrically charging the surface of the photosensitive drum 20, the charging device 25 applies a uniform voltage to the whole surface. However, as has been described previously, no-toner adhesion areas have a lower electric potential than toner adhesion areas. Therefore, after newly charging the surface, the no-toner adhesion areas have a lower electric potential than the toner adhesion areas.

If the photosensitive drum 20 in a state as described above is subjected to exposure, the electric potential of the no-toner adhesion areas drops to be lower than an electric potential which is originally intended. Further, if development is carried out subsequently to the exposure, a greater amount of toner than an originally intended amount adheres to the no-toner adhesion areas. Therefore, density in the no-toner adhesion areas rises to be higher than originally intended density which is based on image data. In a toner image obtained as a result of transfer to the transfer belt 8, a one-turn old toner image the density of which is inverted is overlaid at a low density over a toner image which is originally intended to be transferred. If such a resultant toner image is further transferred to a recording medium 10, areas corresponding to the one-turn old toner image appear relatively light in density. An image which is thus overlaid with inverted density is generally referred to as a negative ghost.

Depending on conditions for image formation, an electric potential in no-toner adhesion areas often becomes higher than that of toner adhesion areas. In this case, a one-turn old image remaining on the photosensitive drum 201 is overlaid at a low density without inversion of density. This image is referred to as a positive ghost. Negative and positive ghosts are collectively referred to as latent image ghosts.

Another known factor which involves negative ghosts is a drop in sensitivity of the photosensitive drum 20. In areas on the photosensitive drum 20 where a latent image has been written, sensitivity to light drops. Accordingly, the higher the density of a latent image is, the greater the drop is. In this case, the light sensitivity drops in areas where a one-turn old latent image has been written. In the areas where the light sensitivity has dropped, reduction in electric potential which is caused by exposure to an exposure beam LB having a uniform intensity is smaller than in the other areas where the light sensitivity has not dropped. In this case, also, areas corresponding to one-turn old image appear lighter in density.

Next, a manner in which a negative ghost occurs will be described with reference to an example of a monochrome image.

Figure 2:
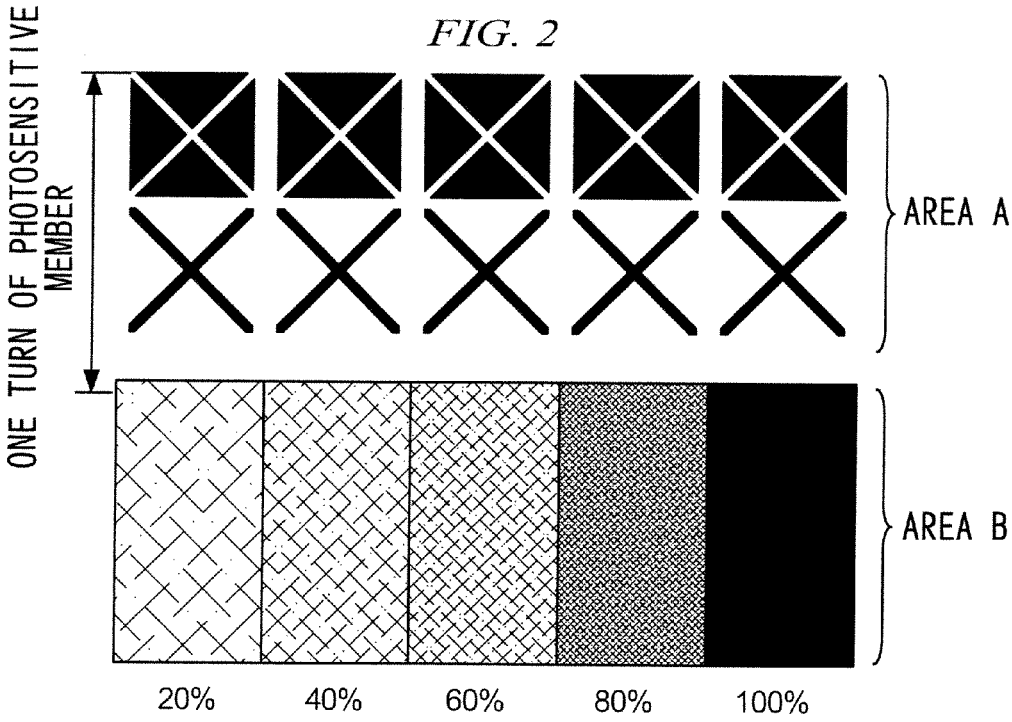
FIG. 2 shows an example of an image which involves no negative ghost.

FIG. 2 shows examples of images which involve no negative ghost. In this figure, an image in an area A contains outlined white x marks and black x marks. An area B contains plural rectangles which are respectively painted at different uniform densities. The rectangles have an image area coverage (Cin)=20, 40, 60, 80, and 100% ordered from the left side of the figure. The longitudinal dimensions of the areas A and B are each equal to the circumferential dimension of the photosensitive drum 20.

Figure 3:
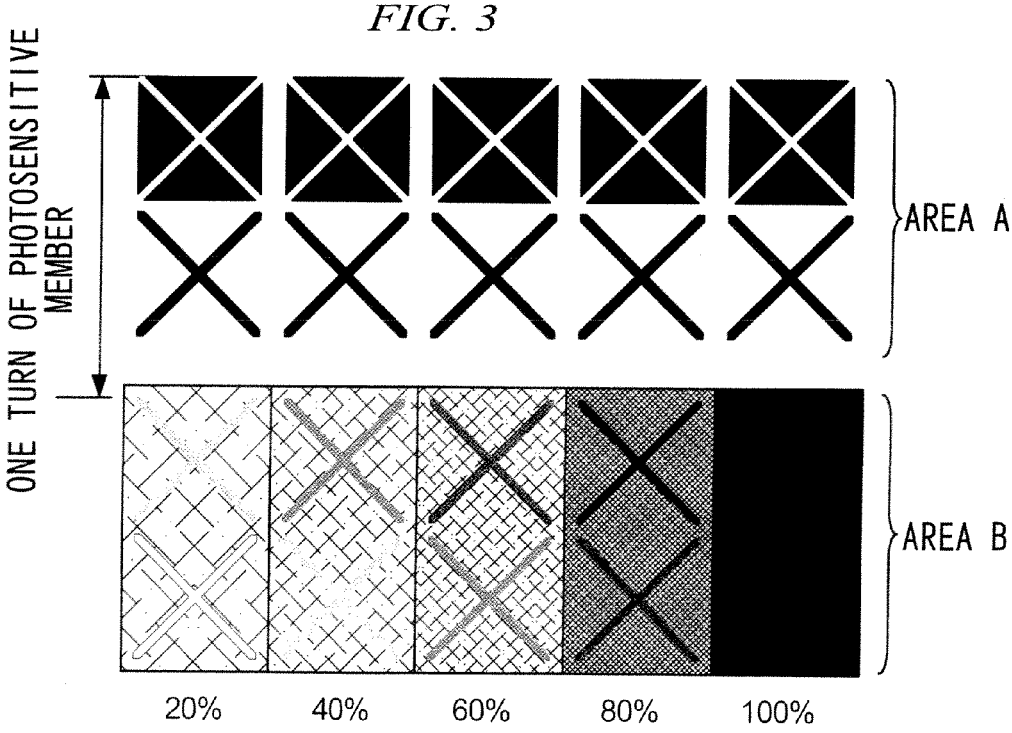
FIG. 3 shows an example of an image in which negative ghosts emerge.

In contrast, FIG. 3 shows examples of images in which negative ghosts emerge. These images are formed on a recording medium 10 in an order of areas A to B by inputting image data expressing the images shown in FIG. 2 to an image forming device which does not employ the ghost correction unit 100. That is, the image of the area A is formed by first one turn of the photosensitive drum 20. The image of the area B is formed subsequently by another one turn of the photosensitive drum 20. As shown in the figure, black x marks emerge in the area B at positions corresponding to outlined white x marks in the area A, due to occurrence of negative ghosts. Also, outlined white x marks emerge at positions corresponding to black x marks. In FIG. 3, negative ghosts are exaggerated in order to facilitate ease of understanding of the exemplary embodiment.

Described next will be a structure of the ghost correction units 100. Since the ghost correction units 100Y, 100M, 100C, and 100K have a common structure to each other, only the ghost correction unit 100K will be representatively described in the following.

Figure 4:
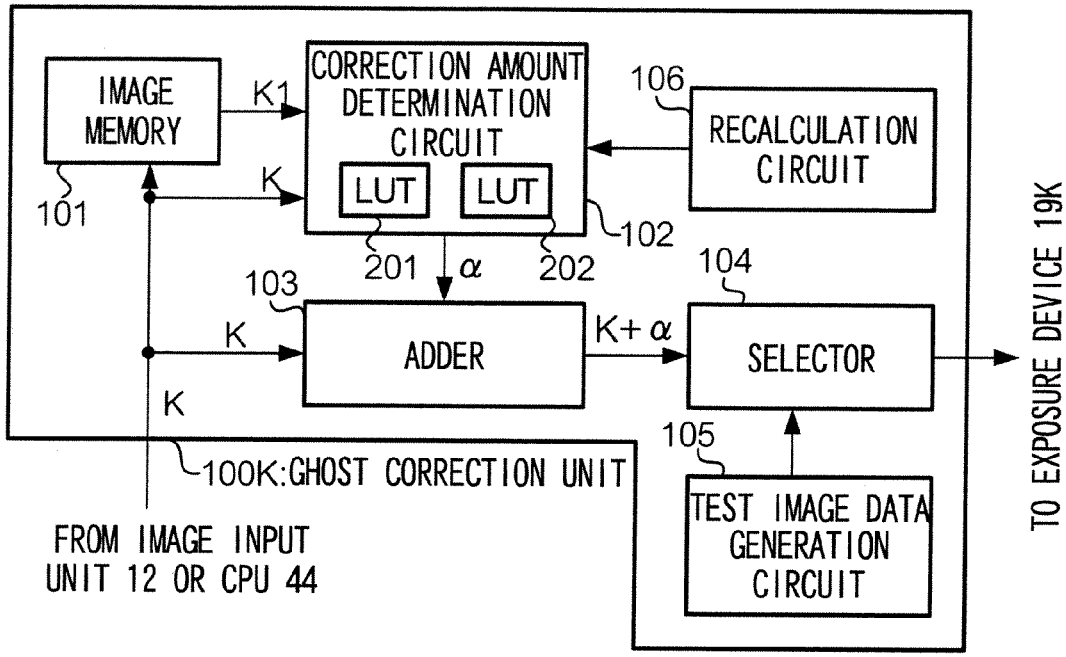
FIG. 4 shows a structure of a ghost correction unit 100.

FIG. 4 shows a structure of the ghost correction unit 100K.

Image data K is data of a raster format expressing an image in color K, and is supplied from the image input unit 12, for example. Alternatively, the Image data K may be obtained in a manner that the CPU 44 converts document data or the like, which is received through a communication I/F 48, into a raster format. The Image data K expresses an image area coverage (Cin) of each pixel as one of 256 gradations, i.e., a value from 0 to 255. K=0 corresponds to Cin=0%, and K=255 corresponds to Cin=100%.

The image memory 101 is, for example, a FIFO (First in First out) memory and has a capacity equal to a data volume of image data K equivalent to a latent image to be formed by one turn of the photosensitive drum 20K. When image data K is supplied from the image input unit 12 or CPU 44, the image memory 101 firstly stores a data volume of the Image data K equivalent to a latent image to be formed by one turn of the photosensitive drum 20K. Thereafter, in synchronization with input of subsequent bits of the image data K, the image memory 101 outputs stored bits ordered from the oldest one of the stored bits, as image data K1, to the correction amount determination circuit 102. That is, the image data K1 is equivalent to a latent image formed by an immediately previous one turn of the photosensitive drum 20K, just prior to the turn to form the latent image of the image data K, which is input in synchronization with output of the image data K1.

The correction amount determination circuit 102 determines a correction amount for correcting image data K, and outputs a determined correction amount to an adder 103. This process is specifically carried out as follows.

At first, in synchronization with input of Image data K to the image memory 101, the same image data K is input to the correction amount determination circuit 102. As described previously, the image memory 101 outputs image data K1 to the correction amount determination circuit 102 in synchronization with input of the image data K. Therefore, the image data K and the image data K1 are synchronously input to the correction amount determination circuit 102.

The correction amount determination circuit 102 internally has a memory in which one-dimensional LUT (Look Up Table) 201 and a one-dimensional LUT 202 are written. The one-dimensional LUT 201 holds pixel values of image data K and correction amounts β associated with each other. The one-dimensional LUT 202 holds pixel values of image data K1 and correction amounts γ associated with each other. The correction amounts β and γ are obtained in advance by a predetermined method.

Figure 5:
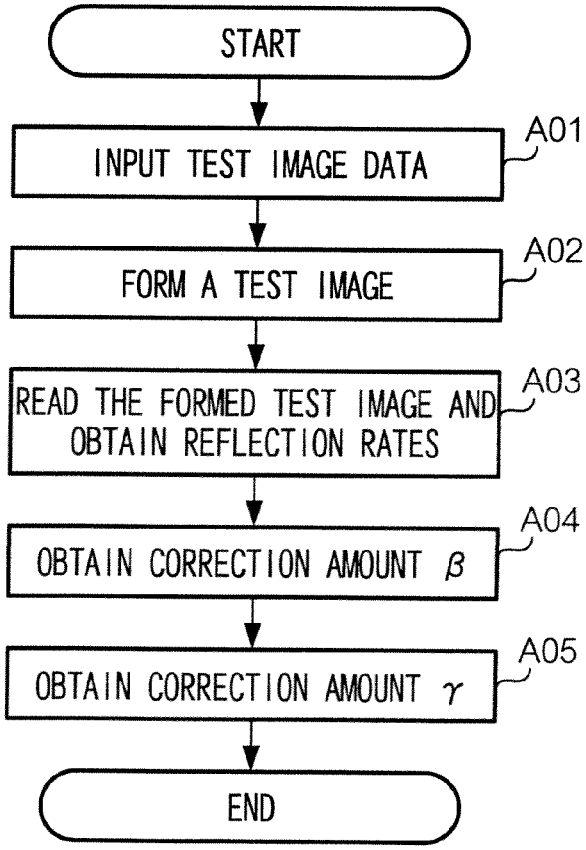
FIG. 5 is a flowchart showing a process of obtaining correction amounts β and γ.

A process for obtaining the correction amounts β and γ will now be described. FIG. 5 is a flowchart showing the process for obtaining the correction amounts β and γ.

Figure 6:
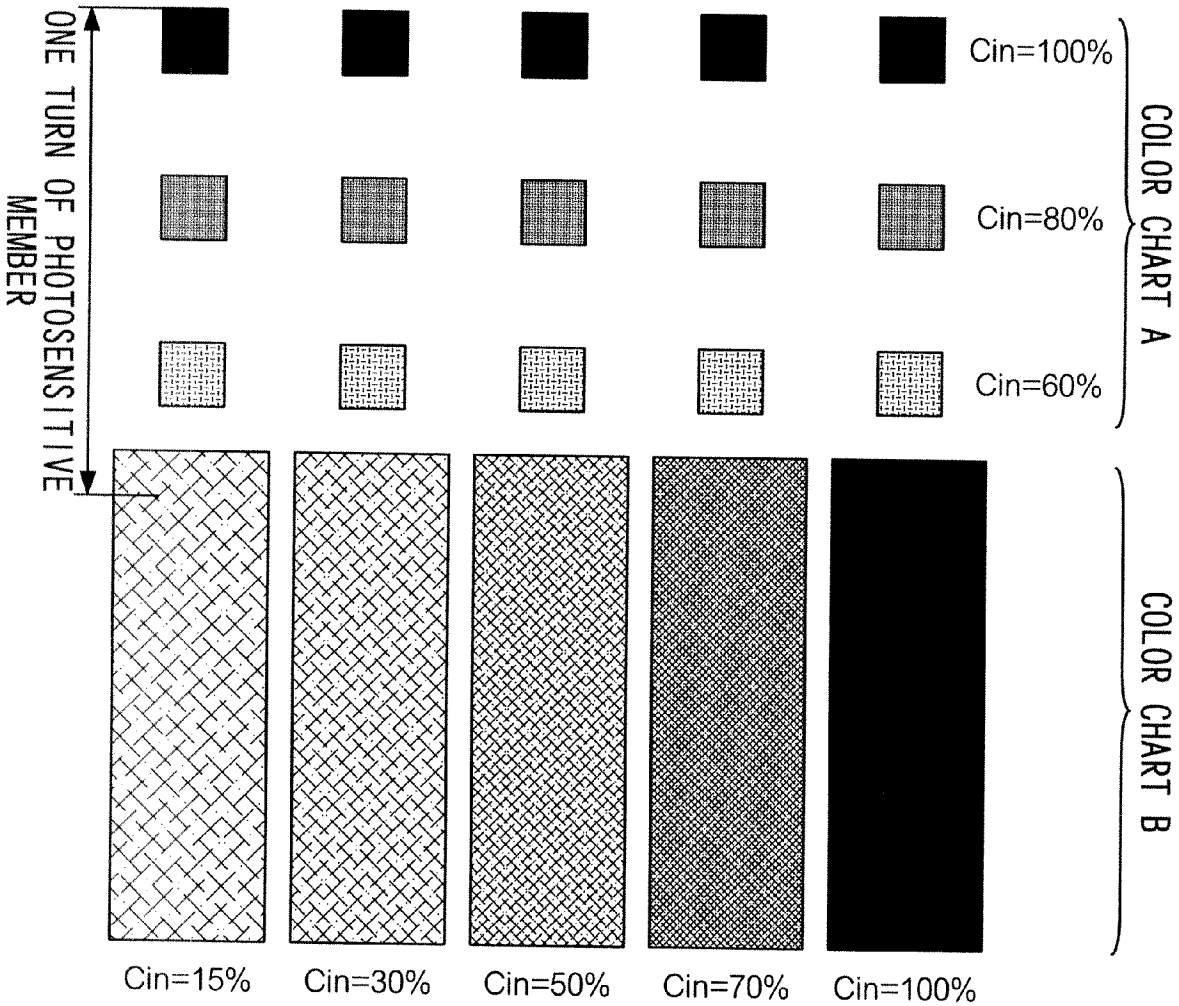
FIG. 6 shows an example of a test image.

To obtain the correction amounts β and γ, test image data expressing a test image is firstly input to the image output unit 6 (step A01). FIG. 6 shows an example of a test image which is used when obtaining the correction amounts β and γ. The vertical lengths of color charts A and B in the figure are equal to the circumferential length of the photosensitive drum 20K. The color chart A includes plural patches arrayed in three rows each including patches having a uniform density, and the rows include patches of Cin=100, 80, and 60%, respectively, ordered from the top of the figure. Each of the patches in the color chip B has a uniform density and a size that is sufficient to cover patches arrayed in one column in the color chart A all at once.

Figure 7:
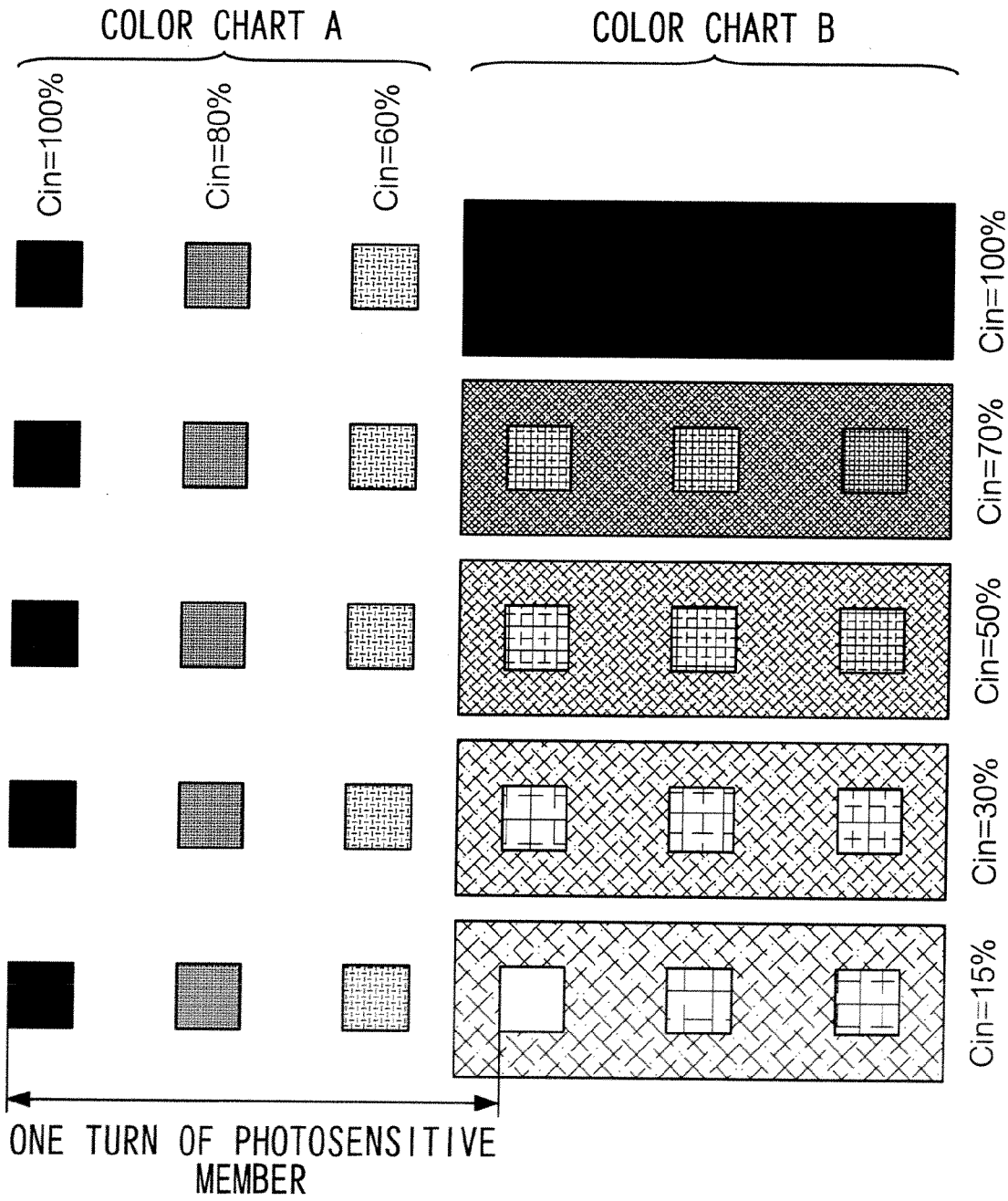
FIG. 7 shows a test image formed in accordance with test image data.

Next, the test image data described above is used to form a test image on a recording medium 10 by the image output unit 6 (step A02). FIG. 7 shows a formed test image. In this example, the image of the color chart A is formed by first one turn of the photosensitive drum 20K, and subsequently, the image of the color chart B is formed by the next one turn. As shown in the figure, negative ghosts of the color chart A emerge in the color chart B. In each of the areas of the color chart B which correspond to the patches of the color chart A, a density drops to be lower than a density of the other peripheral areas. The higher the value of Cin in the color chart A is, the more the density drops in the areas corresponding to the patches of the color chart A. In addition, the lower the value of Cin in the color chart B is, the more the density drops in the areas corresponding to the patches of the color chart A.

In the following description, areas where density has dropped due to occurrence of negative ghosts will be referred to as "ghost parts", and areas where no ghost emerges will be referred to as "background parts". That is, in the above example, the areas of the color chart B which correspond to the patches of the color chart A are ghost parts, and the other areas of the color chart B are background parts.

Figure 8:
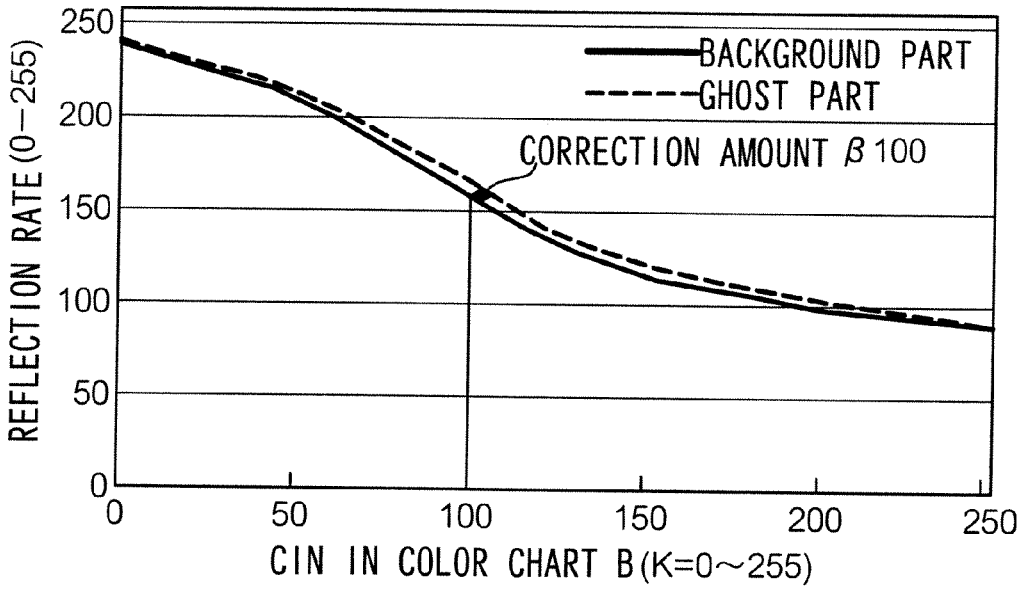
FIG. 8 is a graph showing a relationship between Cin in a color chart B and reflection rates.

Next, the color chart B shown in FIG. 7 is read by the image input unit 12, and read image data is converted into reflection rates (step A03). This processing is carried out for each value of Cin. FIG. 8 is a graph showing a relationship between Cin in the color chart B and reflection rates at ghost parts corresponding to patches of Cin=100%. In the graph, the horizontal axis represents Cin of the color chart B, and the vertical axis represents the reflection rates. The reflection rates at ghost parts are plotted by a broken line, and reflection rates at background parts are plotted by a solid line.

As shown in the graph, where reflection rates are compared for each value of Cin, reflection rates at ghost parts are higher than those at respectively related background parts, i.e., densities of ghost parts are lower than densities of respectively related background parts. In this exemplary embodiment, the image data K is corrected so that reflection rates at ghost parts become equal to reflection rates at background parts (step A04). Specifically, a correction amount β100 is defined to be a result of subtracting a value Cin of a background part from a value Cin of a related ghost part A suffix "100" to "β" indicates a value of Cin in the color chart A. In the example of negative ghosts shown in the figure, the correction amounts β100 are positive values. In the case of positive ghosts, the correction amounts β100 are negative values.

Figure 9A:
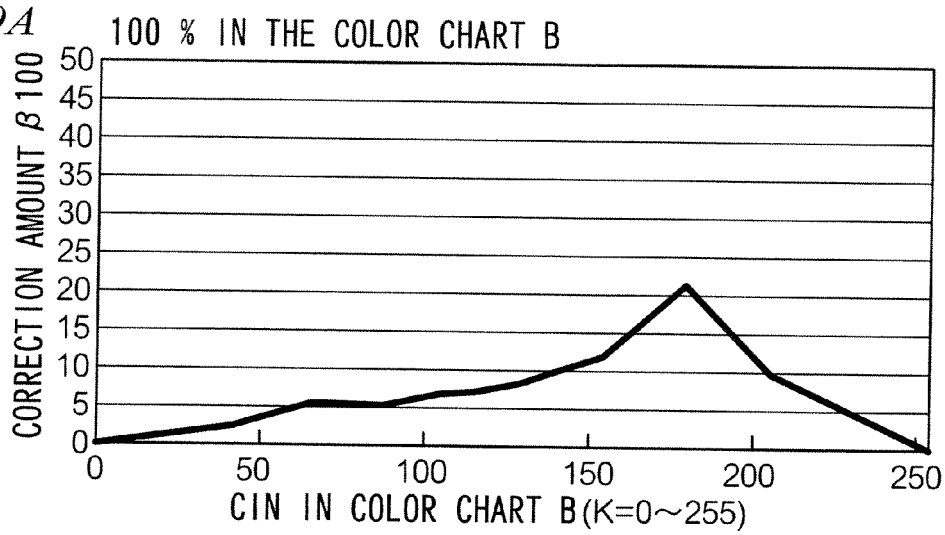
FIGS. 9A, 9B, and 9C are graphs each showing a relationship between a correction amount β and Cin in the color chart B.

FIG. 9A is a graph showing a relationship between Cin in the color chart B and the correction amounts β100 obtained by the process as described above. In this example, the correction amounts β100 are obtained for Cin=15, 30, 50, 70, and 100%, and are appropriately subjected to compensation.

Figure 9B:
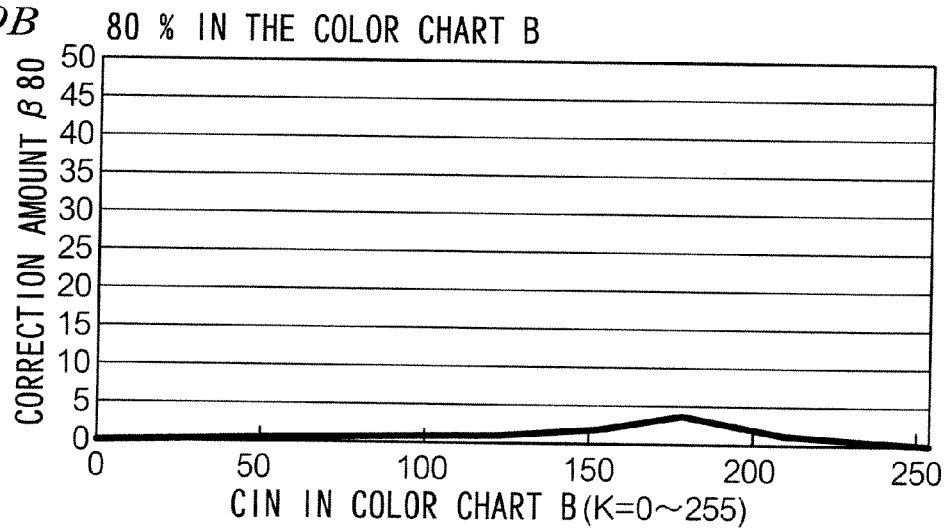
Figure 9C:
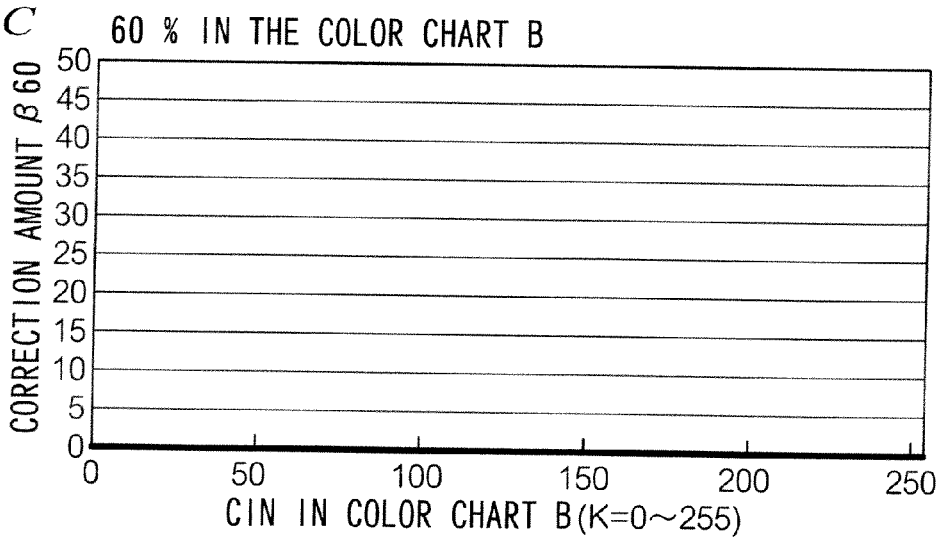

Further, correction amounts β are obtained for ghost parts corresponding to patches of Cin=80 and 60% in the color chart A in the same manner as described above. FIG. 9B shows a relationship between Cin in the color chart B and correction amounts β80 for patches of Cin=80% in the color chart A. FIG. 9C shows a relationship between Cin in the color chart B and correction amounts β60 for patches of Cin=60% in the color chart A.

Figure 10:
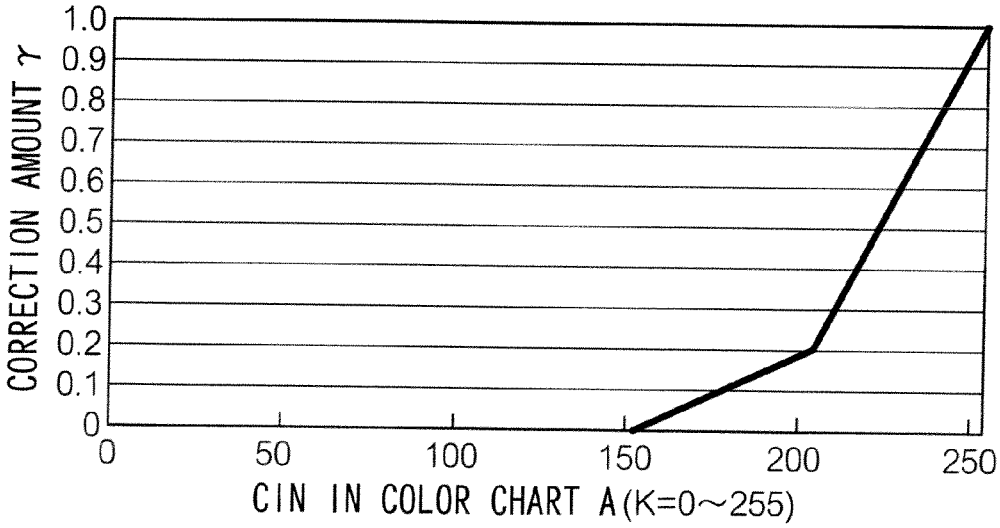
FIG. 10 is a graph showing a relationship between a correction amount γ and Cin in a color chart A.

Next, a ratio of β80 to β100 is obtained (step A05). For example, for each of Cin=15, 30, 50, 70, and 100% in the color chart B, a ratio of β80 to β100 is obtained. An average value is further calculated from the obtained ratios. Also for Cin=15, 30, 50, 70, and 100% in the color chart B, an average value of ratios of β60 to β100 is obtained. Each average value obtained in this manner is referred to as a correction amount γ. FIG. 10 is a graph showing a relationship between the correction amounts γ and Cin in the color chart A. As shown in this graph, the correction amount γ=1 is obtained where Cin=100% is given. In accordance with a decrease of Cin in the color chart A, the correction amount γ decreases abruptly.

In place of the average values of ratios of β80 to β100 and ratios of β60 to β100, maximum values of these ratios may be used as correction amounts γ.

The correction amounts β and γ are obtained through the process as described above.

Correction amounts β100 obtained through the process as described above are written, associated with values of image data K, in the one-dimensional LUT (Look Up Table) 201 which the correction amount determination circuit 102 has. In the one-dimensional LUT 202, correction amounts γ obtained also through the process as described above are written associated with values of the image data K1. The correction amount determination circuit 102 obtains correction amounts β100 and γ, for each pixel of the image data K and image data K1. Specifically, for each pixel of the image data K, a correction amount 100 is obtained from the one-dimensional LUT 201. For each pixel of the image data K1, a correction amount γ is obtained from the one-dimensional LUT 202. The correction amount β100 is multiplied by the correction amount γ to obtain a correction amount α, for each of pixels arranged respectively at common positions between both of image data. The obtained correction amount α is output to the adder 103.

In synchronization with input of the image data K from the correction amount determination circuit 102, the adder 103 is input with the same image data K, and adds the correction amount α output from the correction amount determination circuit 102 to the image data K, to obtain image data K+α. The adder 103 outputs the image data K+α to a selector 104.

The adder 104 outputs the image data K+α to the image output unit 6. The image output unit 6 then forms an image on a recording medium 10 in accordance with the image data K+α. As a result, an image from which occurrence of latent image ghosts is suppressed is obtained as shown in FIG. 6.

A test image data generation circuit 105 and a recalculation circuit 106 are provided to recalculate the correction amounts β and γ. The correction amounts β and γ are recalculated on the following grounds.

A degree of occurrence of latent image ghosts varies depending on elapse of time and on environmental change inside the image forming device 1. For example, as a total operating time of the image forming device 1 extends, the surface of the photosensitive drum 20 becomes increasingly abraded. The degree of occurrence of latent image ghosts accordingly varies depending on a degree of such abrasion. If a photosensitive drum 20 which is abraded severely is replaced with a new photosensitive drum, the degree of occurrence of latent image ghosts differs from that before the replacement. The degree of occurrence of latent image ghosts also varies depending on a change in temperature in the image forming device 1. In order to maintain excellent image quality, the correction amounts β and γ need to be varied in accordance with such a change.

Hence, this exemplary embodiment is configured so that content of the one-dimensional LUTs 201 and 202 can be rewritten by the correction amounts β and γ. Specifically, this exemplary embodiment is configured as follows.

The correction amounts β and γ are recalculated as a user inputs a predetermined instruction to the instruction receiving unit 41. For example, the user visually checks an image formed by the image forming device 1. If occurrence of a latent image ghost is observed, the user inputs a predetermined instruction. More specifically, the user selects an item "Adjust image quality" displayed on the display 39 of the instruction receiving unit 41, and then, a menu for adjusting image quality shows up. From the menu, the user selects an item "Recalculate ghost correction amounts".

Upon input of the predetermined instruction as described above to the instruction receiving unit 41, the test image data generation circuit 105 generates test image data expressing a test image shown in FIG. 6, and outputs the test image data to the selector 104.

The selector 104 outputs the input test image data to the image output unit 6. Then, processings are performed in accordance with the process of steps A01 to A05 described previously Processings of steps A03 to A05 are executed by the recalculation circuit 106. The recalculation circuit 106 is, for example, a computer which includes a CPU, a ROM, and a RAM. The ROM contains a program which describes the processings of steps A03 to A05. As the CPU reads this program onto the RAM and executes the program, the processings of the steps A03 to A05 are carried out. The correction amounts β and γ are obtained accordingly. The obtained correction amounts β and γ are written into the one-dimensional LUTs 201 and 202. Thereafter, the correction amount determination circuit 102 is used to determine a correction amount α.

The description made above has exemplified a case of correcting negative ghosts. Needless to say, positive ghosts can also be corrected with the configuration as described above.

The invention is not limited to the exemplary embodiment described above but can be variously modified in practice. For example, the following modifications can be made to the above exemplary embodiment in practice.

Modification 1

The above exemplary embodiment has exemplified a case in which the correction amounts β100 and γ for each of the image data K and the image data K1 are read from the one-dimensional LUTs 201 and 202, to determine the correction amount α. However, the exemplary embodiment may alternatively be configured so as to use a two-dimensional LUT. That is, the correction amount determination circuit 102 may be provided with a two-dimensional LUT 102 which holds correction amounts α applicable to a combination of the image data K and the image data K1. For each pixel, a correction amount U applicable to a combination of the image data K and the image data K1 is obtained from the two-dimensional LUT.

Alternatively, the exemplary embodiment may be configured so that a memory stores a function expressing correspondence between the image data K and the correction amount β100, and a function expressing correspondence between the image data K1 and the correction amount γ. The correction amounts β and γ may be obtained by using the functions.

Modification 2

The above exemplary embodiment has exemplified a case in which, if a user determines a need for a recalculation, the user gives an instruction to recalculate the correction amounts β and γ. However, the exemplary embodiment may alternatively be configured so that a recalculation is executed in a case as follows. That is, each time when the number of pages of images formed by the image forming device 1 reaches a predetermined value, the CPU 44 may instruct the ghost correction unit 100 to execute a recalculation.

Modification 3

As shown in FIG. 7, latent image ghosts tend to emerge more clearly in accordance with an increase in density of a latent image formed by an immediately previous turn of a photosensitive drum. As shown in FIG. 10, occurrence of latent image ghosts is limited to a case in which density of a latent image formed by an immediately previous turn of the photosensitive drum is equal or close to a maximum density (Cin=100%). Accordingly, test image data which contains only patches of Cin=100% may be used for recalculating the correction amounts β and γ. In this case, the correction amount β100 is obtained through the process as described above. For other values of Cin, the correction amounts α each are obtained by multiplying the correction amount β100 by the correction amount γ which is written in advance in the one-dimensional LUT 202.

Modification 4

In the above exemplary embodiment a configuration of correcting latent image ghosts in accordance with image data equivalent to a latent image formed by an immediately previous turn of a photosensitive drum is exemplified. The invention is not limited to this configuration. For example, the development device 22 has a developing roller which is a cylindrical member. The developing roller is electrically charged to an opposite polarity to the photosensitive drum 20, and is driven to rotate in a predetermined direction. Toner supplied from the toner cartridge 23 adheres to the surface of the developing roller, and moves to the surface of the photosensitive drum 20 due to a difference in electric potential between the developing roller and an electrostatic latent image. At this time, a difference in electric potential is caused on the surface of the developing roller between parts from which the toner has moved and parts where the toner remains. For a next developing operation, the developing roller should desirably be electrically charged uniformly. However, the amount of toner which adheres in the next developing operation is not uniform due to influence of the difference in electric potential which occurred in an immediately previous developing operation. As a result, there is a case that a latent image ghost emerges.

Also in this case, a latent image ghost can be suppressed according to the configuration of the above exemplary embodiment. That is, image data K equivalent to one turn of a developing roller is stored into an image memory 101. The correction amount a may then be obtained in the same process as described in the above exemplary embodiment, based on the stored image data K and image data K1 equivalent to an immediately previous turn of the developing roller.

Modification 5

In the above exemplary embodiment a case in which the correction amount β100 is a resultant obtained by subtracting Cin of a background part from Cin of a ghost part is exemplified. Alternatively, for example, a ratio of Cin of a ghost part to Cin of a background part may be obtained and used as the correction amount β100. In this case, a product of β100 multiplied by γ is taken as the correction amount α, and image data K is multiplied by the correction amount α. In this manner, a density of a ghost part can be equalized to a density of a background part.

Modification 6

The above exemplary embodiment has exemplified a case where the correction amounts β and γ are written in advance in the one-dimensional LUTs 201 and 202. However, the correction amounts β and γ need not be written in advance. In this case, when correcting latent image ghosts for the first time in the image forming device 1, the correction amounts β and γ may be obtained in the same manner as in the recalculation described previously. The correction amounts β and γ may be written into the one-dimensional LUTs 201 and 202 and may then be used for correction.

Modification 7

The above exemplary embodiment has exemplified a case of using a FIFO memory as the image memory 101. The image memory 101 is not limited to this exemplary embodiment. The image memory 101 needs only to be configured so as to maintain input image data K and to output subsequent bits to the image data K and bits equivalent to a latent image formed by an immediately previous turn of the photosensitive drum 20, to the correction amount determination circuit 102, in synchronization with input of the subsequent bits.

Modification 8

The above exemplary embodiment has exemplified a case in which components other than the recalculation circuit 106 of the ghost correction unit 100 are constituted as hardware. Alternatively, however, a program for causing a computer to function as a ghost correction unit 100 may be stored in advance in the storage unit 5. Processings described in the above exemplary embodiment may be executed as the CPU 44 executes the program.

The program may be recorded on a recording medium such as an optical disk, and the program may be read from the recording medium and stored into the storage unit 5. Alternatively, the program may be received via a communication network, and the received program may be written into the storage unit 5.

Modification 9

The above exemplary embodiment has exemplified a case of applying the invention to an image forming device which has four image forming engines which respectively correspond to four different colors. Alternatively, the invention may be applied to an image forming device which has three or less image forming engines or five or more image forming engines.

Modification 10

The above exemplary embodiment is configured so that, when recalculating the correction amount α, a test image transferred to a recording medium 10 is read by the image input unit 12. Alternatively, however, a test image formed on the transfer belt 8 may be read instead. For example, a reading device constituted of a CCD may be provided so as to oppose an outer circumferential surface of the transfer belt 8, and a test image transferred to the transfer belt 8 may be read by the reading device. Image data obtained by the reading device may be converted into reflection rates from which the correction amount α is obtained through the process described with reference to steps A04 and A05 in the above exemplary embodiment.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principle of the invention and its practical application, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

an imaging unit comprising:

a rotating body that is driven to rotate and has a surface, electric potential of which changes in response to light;

an exposure unit that irradiates the surface of the rotating body on the basis of input image data to form an electrostatic latent image;

a developing unit that develops the electrostatic latent image using developer to form an image; and a transfer unit that transfers the image formed by the developing unit to a recording medium;

a memory that stores data of a first image data, the first image data being input to the exposure unit and representing a first latent image to be formed by a first turn of the rotating body, a second image data being input to the exposure unit and representing a second latent image to be formed by a second turn of the rotating body subsequent to the first turn, and a first correction amount being used for correcting the second image data so that the density of an image transferred to a recording medium when the second image data is input to the exposure unit becomes closer to the density of the second latent image represented by the second image data;

a correction amount determining unit that determines the first correction amount corresponding to the first image data and the second image data on the basis of the data stored in the memory; and a correcting unit that corrects the second image data to be input to the exposure unit, on the basis of the first correction amount determined by the correction amount determining unit.

2. The image forming device according to claim 1, wherein:

the memory comprises:

a first memory area that stores data of a second correction amount and the second image data, the second correction amount being obtained when the density of the first latent image represented by the first image data is maximal; and a second memory area that stores data of a ratio of a third correction amount to the second correction amount and the first image data, the third correction amount being obtained when the density of the first latent image represented by the first image data is not maximal; and the correction amount determining unit determines the second correction amount corresponding to the second image data on the basis of the data stored in the first memory area, determines the ratio corresponding to the first image data on the basis of the data stored in the second memory area, and multiplies the second correction amount by the ratio to obtain the first correction amount.

3. The image forming device according to claim 2, further comprising:

a reading unit that reads a test image including a first area in which an image of a first color chart the density of which is maximal, is formed by a third turn of the rotating body and a second area in which an image of a second color chart the density of which is not maximal, is formed by a fourth turn of the rotating body subsequent to the third turn, the image of the second color chart including a third area that if the first area is overlaid on the second area overlaps the image of the first color chart; and a fourth area that if the first area is overlaid on the second area, does not overlap the image of the first color chart; and a recalculating unit that obtains a value of a difference between the density of the third area of the image of the second color chart and the density of the fourth area of the image of the second color chart, and writes the value in the first memory area as the second correction amount.

4. An image processing device comprising:

a memory that stores data of a first image data, a second image data, and a first correction amount, the first image data and the second image data being input to an imaging unit comprising:

a rotating body that is driven to rotate and has a surface, electric potential of which changes in response to light;

an exposure unit that irradiates the surface of the rotating body on the basis of input image data to form an electrostatic latent image;

a developing unit that develops the electrostatic latent image using developer to form an image; and a transfer unit that transfers the image formed by the developing unit to a recording medium, and the first image data representing a first latent image to be formed by a first turn of the rotating body, the second image data representing a second latent image to be formed by a second turn of the rotating body subsequent to the first turn, and the first correction amount being used for correcting the second image data so that the density of an image transferred to a recording medium when the second image data is input to the exposure unit becomes closer to the density of the second latent image represented by the second image data; and a correction amount determining unit that determines the first correction amount corresponding to the first image data and the second image data on the basis of the data stored in the memory; and a correcting unit that corrects the second image data to be input to the exposure unit, on the basis of the first correction amount determined by the correction amount determining unit.

5. An image forming method comprising the steps of:

determining a first correction amount, being used for correcting a second image data so that the density of an image transferred to a recording medium when the second image data is input to an exposure unit becomes closer to the density of a second latent image represented by the second image data, corresponding to a first image data and the second image data on the basis of the data stored in a memory that stores data for the first image data, the second image data, and the first correction amount; and correcting the second image data to be input to the exposure unit, on the basis of the determined first correction amount.

6. A computer readable medium storing a program causing a computer to execute a process for an image forming, the process comprising:

determining a first correction amount, being used for correcting a second image data so that the density of an image transferred to a recording medium when the second image data is input to an exposure unit becomes closer to the density of a second latent image represented by the second image data, corresponding to a first image data and the second image data on the basis of the data stored in memory that stores data for the first image data, the second image data, and the first correction amount; and correcting the second image data to be input to the exposure unit, on the basis of the determined first correction amount.

7. The image forming method according to claim 5, wherein the first image data being input to the exposure unit and representing a first latent image to be formed by a first turn of the rotating body, and the second image data being input to the exposure unit and representing the second latent image to be formed by a second turn of the rotating body subsequent to the first turn.

8. The process according to claim 6, wherein the first image data being input to the exposure unit and representing a first latent image to be formed by a first turn of the rotating body, and the second image data being input to the exposure unit and representing the second latent image to be formed by a second turn of the rotating body subsequent to the first turn.

* * * * *